US008033416B2

(12) United States Patent
Wang

(10) Patent No.: US 8,033,416 B2
(45) Date of Patent: Oct. 11, 2011

(54) PRESSURE TANK HAVING PLURAL ACCESS OPENINGS

(76) Inventor: Li-Ming Wang, Shengang Township, Taichung County (TW)

( * ) Notice: Subject to any disclaimer, the term of this patent is extended or adjusted under 35 U.S.C. 154(b) by 417 days.

(21) Appl. No.: 12/289,409

(22) Filed: Oct. 28, 2008

(65) Prior Publication Data

US 2010/0084408 A1 Apr. 8, 2010

(30) Foreign Application Priority Data

Oct. 7, 2008 (TW) ..... 97138611 A

(51) Int. Cl.
*F17C 1/00* (2006.01)

(52) U.S. Cl. ..... 220/584; 220/581; 220/720; 220/721; 220/723

(58) Field of Classification Search ..... 215/12.1, 215/12.2, 13.1; 220/62.22, 62.12, 592.16, 220/592.17, 574, 592.25, 592.26
See application file for complete search history.

(56) References Cited

U.S. PATENT DOCUMENTS 1,370,123 A * 3/1921 Knox ..... 220/573.1
4,474,215 A * 10/1984 Richter et al. ..... 138/30
5,386,925 A * 2/1995 Lane ..... 220/530
6,517,117 B1 * 2/2003 Lai ..... 285/202
6,915,922 B2 * 7/2005 Wang ..... 220/720

FOREIGN PATENT DOCUMENTS

TW M250911 11/2004
TW M312357 5/2007

* cited by examiner

*Primary Examiner* — J. Gregory Pickett
*Assistant Examiner* — Blaine Neway
(74) *Attorney, Agent, or Firm* — Rosenberg, Klein & Lee

(57) ABSTRACT

A pressure tank includes a metallic vessel, a plastic liner received in the metallic vessel, a flexible diaphragm, two metallic joints, two anti-leak assemblies and a nozzle coupled to the metallic joints respectively. The metallic vessel includes upper and lower shells. The upper shell defines a first planar area on a side thereof and a second planar area on a top thereof. The lower shell defines a third planar area therebottom. The flexible diaphragm divides said metallic vessel into a storage space and a pneumatic room. The metallic joints are mounted on the side and top of the upper shell respectively and are in communication with the storage space. The two anti-leak assemblies provide leakproof connection between the metallic joints and the plastic liner. Additionally, the nozzle is mounted on the third planar area to be in communication with the pneumatic room.

1 Claim, 7 Drawing Sheets

PRESSURE TANK HAVING PLURAL ACCESS OPENINGS

BACKGROUND OF INVENTION

1. Field of Invention

This invention relates to a pressure tank and more particularly to a pressure tank having plural access openings for connection with plural pipes.

2. Related Prior Art

Taiwan Pat. No. M250911 and Taiwan Pat. No. M312357 are exemplary of patents directed to pressure tanks of the type to which this invention is directed. Basically, the conventional pressure tank includes a flexible diaphragm through which the inside of the pressure tank is divided into an upper storage space and a lower pneumatic room. However, there is only one access opening (or metallic joint) in the pressure tank to be in communication with the storage space. The only metallic joint is then served as both an inlet and an outlet at different time. It takes huge time simply to access liquid into or out of the storage space. Moreover, since there is only one metallic joint for access, residue dust or dirt may be easily accumulated on the bottom of the storage space, namely on the top surface of the flexible diaphragm, after a long time use.

SUMMARY OF INVENTION

Broadly stated, the present invention is directed to a pressure tank having plural metallic joints for access in such a way that liquid may be efficiently accessed into and out of the pressure tank. In particular, the distinctive arrangement of the metallic joints prevents the pressure tank from contamination accumulation.

The pressure tank includes a metallic vessel, a plastic liner, a flexible diaphragm, two metallic joints, two anti-leak assemblies and a nozzle coupled to the metallic joints respectively. The metallic vessel includes upper and lower shells joined together. The metallic vessel defines a first planar area on the hollow cylinder of the upper shell, a second planar area on the circular plate of the upper shell and a third planar area on a bottom of the lower shell. The plastic liner is received in the upper shell of the metallic vessel. The flexible diaphragm divides said metallic vessel into a storage space and a pneumatic room. The two metallic joints are mounted on the side and top of the upper shell respectively and are in communication with the storage space. The two metallic joints are substantially identical to each other in construction and each includes an exposed tubular portion and an inner tubular portion. The exposed tubular portion has a threaded section, a polygonal section joined to the threaded section and a cylindrical section joined to the polygonal section. The inner tubular portion is joined to the cylindrical section of the exposed tubular portion and passes through the first (or second) planar area of the upper shell and the plastic liner to be in communication with the storage space. The cylindrical section of the exposed tubular portion is weld to an exterior surface of the first (or second) planar area of the upper shell. The inner tubular portion includes a base section and an elastic section extending from the base section. The elastic section is riveted in order to press the plastic liner on an interior surface of the first (or second) planar area of the upper shell. The two anti-leak assemblies provide leakproof connection between the metallic joints and the plastic liner.

Additionally, the nozzle is mounted on the third planar area to be in communication with the pneumatic room and also provides efficient leakproof function.

Since the present invention includes at least two metallic joints, namely the first and second metallic joints to provide plural access openings for connection with plural pipes. Moreover, one of the metallic joints may be served as an inlet and mounted on the top of the metallic vessel while the other served as an outlet and mounted on the side. Since the flexible diaphragm is located exactly between the inlet and the outlet, any residue dust or dirt can hardly left on the flexible diaphragm and can easily be swept away from the storage space via the side outlet, and thereby contamination accumulation is avoid.

The advantages of the present invention will be understood more readily after a consideration of the drawings and the Detailed Description.

BRIEF DESCRIPTION OF DRAWINGS

The invention is illustrated by the accompanying drawings in which corresponding parts are identified by the same numerals and in which.

DETAILED DESCRIPTION OF THE PREFERRED EMBODIMENT

Figure 1:
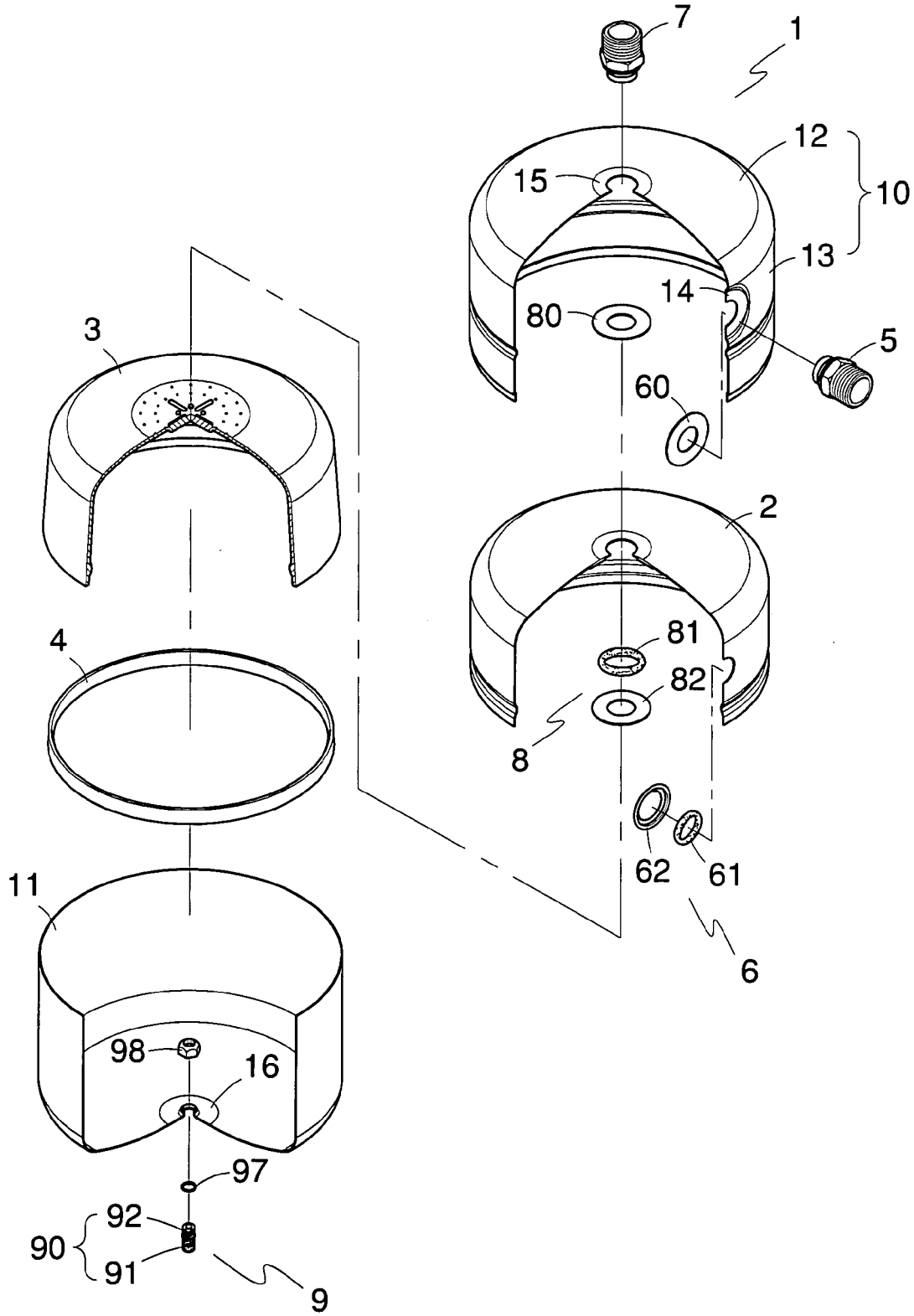
FIG. 1 is an exploded view of a pressure tank in accordance with the preferred embodiment of the invention.

Referring now to the drawings, the pressure tank according to the present invention comprises a metallic vessel 1, a plastic liner 2, a flexible diaphragm 3, a fixing ring 4, a first metallic joint 5, a first anti-leak assembly 6, a second metallic joint 7, a second anti-leak assembly 8 and a nozzle 9.

Figure 2:
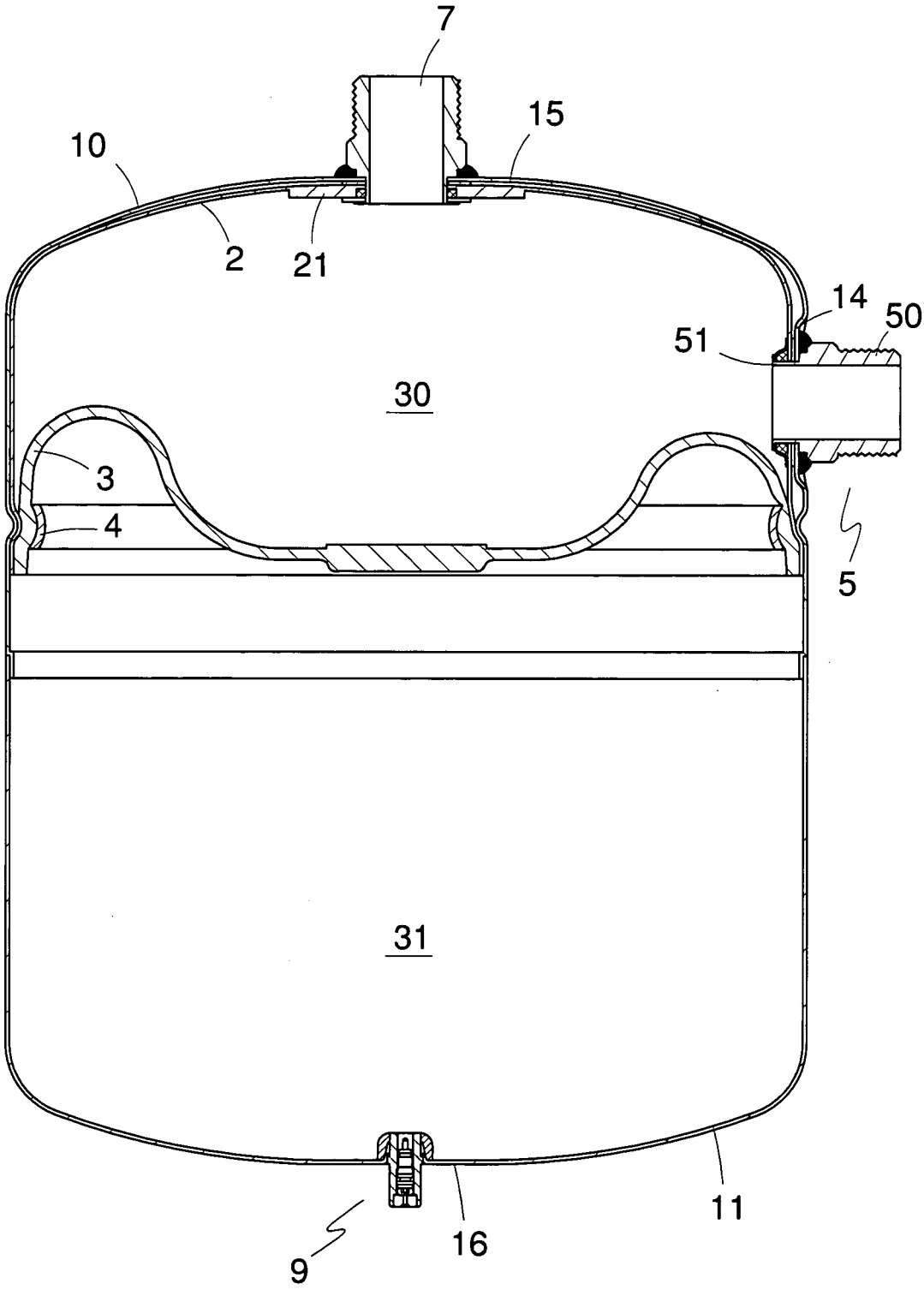
FIG. 2 is a cross section of the pressure tank of FIG. 1.
Figure 7:
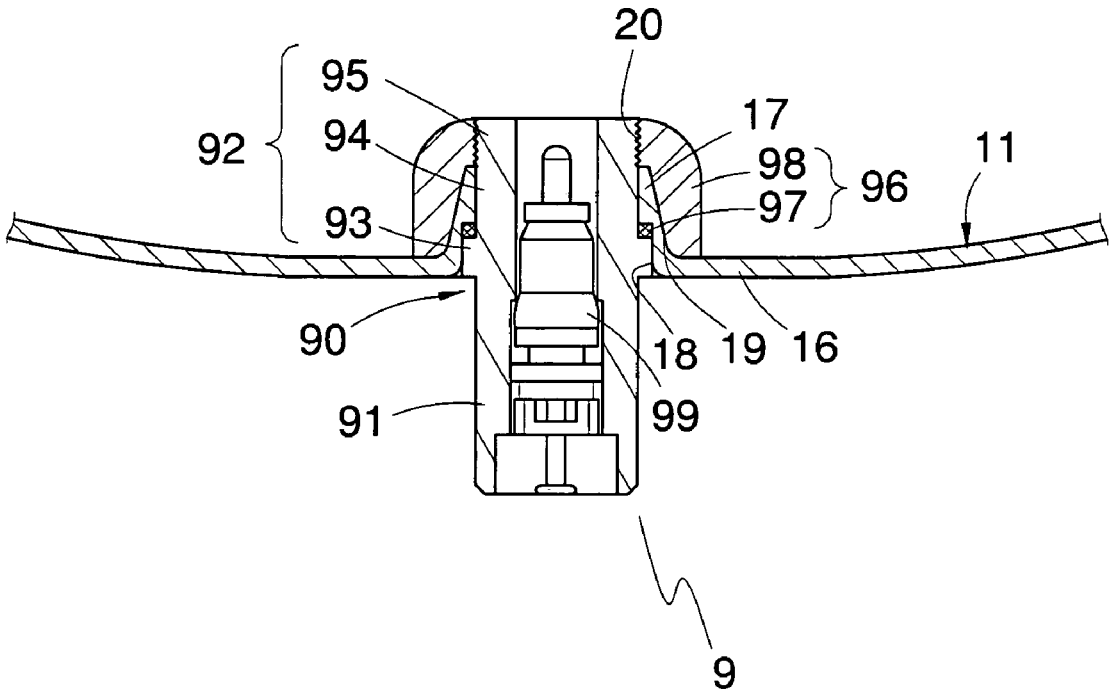
FIG. 7 is a fragmentary assembled view of the pressure tank, showing an arrangement between a nozzle and a lower shell.

As shown in FIGS. 1 and 2, the metallic vessel 1 includes an upper shell 10 and a lower shell 11 joined together, and preferably is made of stainless steel to conform to the requirements of Food and Drug Administration (FDA). The upper shell 10 is formed of a circular plate 12 and a hollow cylinder 13 extending from the periphery of the circular plate 12. The hollow cylinder 13 defines a recessed first planar area 14, as depicted in FIG. 2. A second planar area 15 is defined in the center of the circular plate 12 of the upper shell 10. Moreover, the lower shell 11 defines a third planar area 16 therebottom and formed with an inward tubular protrusion 17 extending inwardly from the third planar area 16, as depicted in FIG. 7. The inward tubular protrusion 17 defines an annular recession 18 adjacent to the third planar area 16. It should be noted that opposite inner and outer surfaces of each of the planar areas 14, 15, 16 are flat and even in order to be easily and firmly weld/connected with the first, second metallic joints 5, 7 and a third metallic joint 90 of the nozzle 9.

Figure 6:
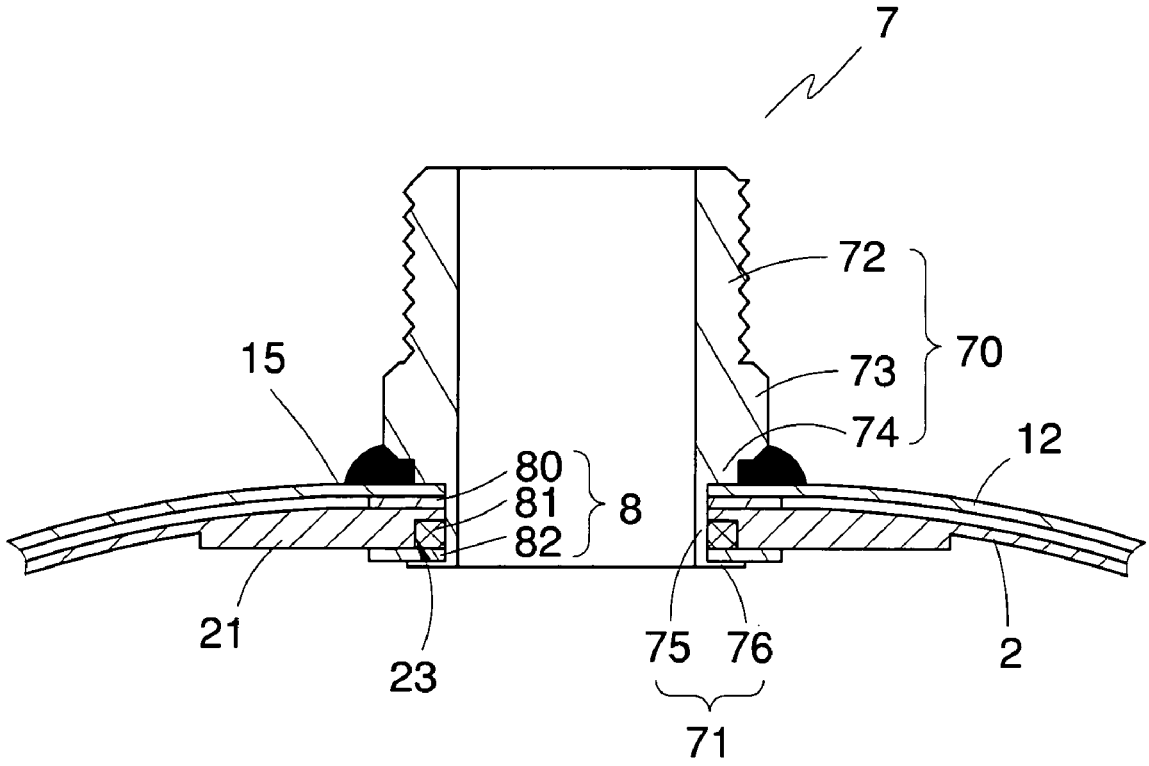
FIG. 6 is an assembled view of the parts shown in FIG. 5.

As shown in FIG. 2, the plastic liner 2 is received in the upper shell 10 and is formed with an inward protrusion 21 on a top thereof. As best seen in FIG. 6, the inward protrusion 21 of the plastic liner 2 defines an annular recession 23 therein.

Referring again to FIG. 2, the flexible diaphragm 3 is made of a rubber material and is disposed inside the plastic liner 2. The flexible diaphragm 3 and the plastic liner 2 co-define an upper storage space 30 therebetween. Likewise, the flexible diaphragm 3 and the lower shell 11 co-define a lower pneumatic room 31 therebetween. The fixing ring 4 is provided to hold the flexible diaphragm 3 against an inner peripheral wall of the plastic liner 2. Further, the flexible diaphragm 3 and the plastic liner 2 are tightly sandwiched between the fixing ring 4 and the upper shell 10 by applying rolling depression upon an exterior periphery of the upper shell 10 of the metallic vessel 1.

Figure 3:
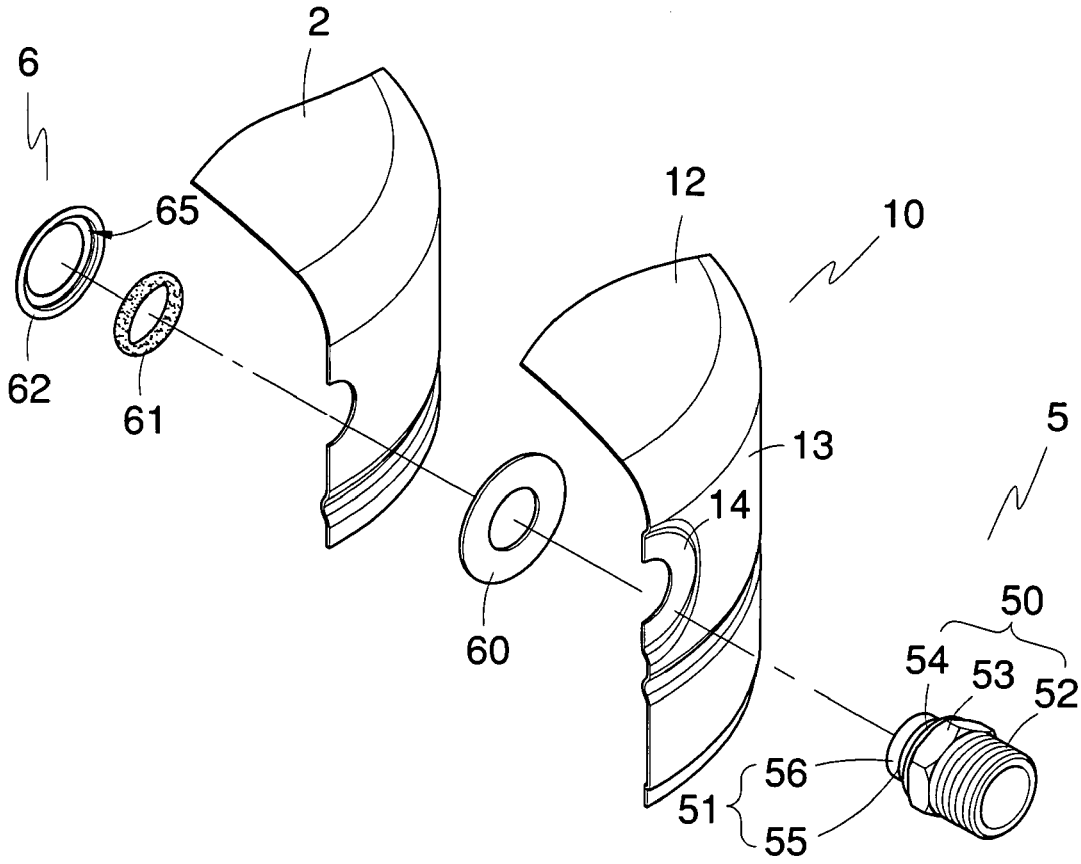
FIG. 3 is a fragmentary exploded view of the pressure tank, showing an arrangement among an upper shell, a first metallic joint and a first anti-leak assembly.
Figure 4:
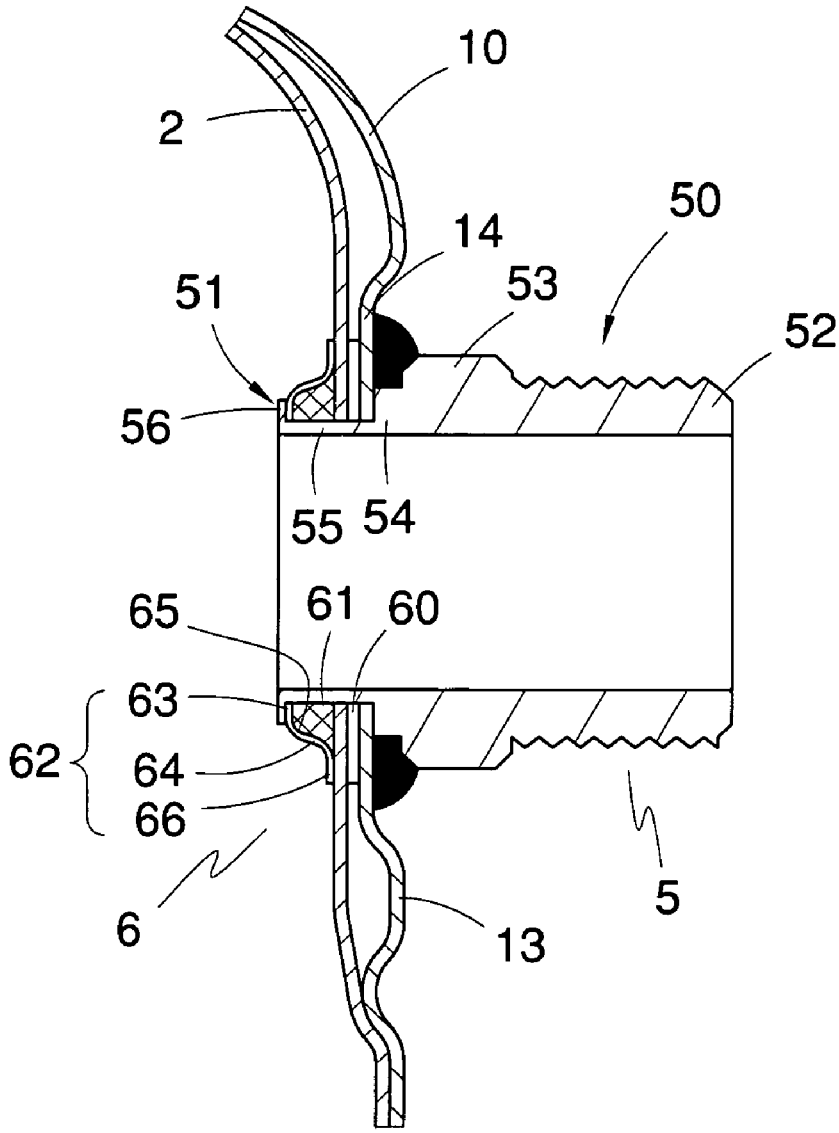
FIG. 4 is an assembled view of the parts shown in FIG. 3.

Referring to FIG. 3, the first metallic joint 5 is mounted on the first planar area 14 and includes an exposed tubular portion 50 and an inner tubular portion 51. The exposed tubular portion 50 is formed with a threaded section 52, a polygonal section 53 and a cylindrical section 54. The threaded section 52 is formed with external thread for connection with a pipe (not shown). In this embodiment, the polygonal section 53 is hexagonal and extends from the threaded section 52. The cylindrical section 54 extends from the polygonal section 53 and is weld to an exterior surface of the first planar area 14 of the hollow cylinder 13 of the upper shell 10. The inner tubular portion 51 includes a base section 55 and an elastic section 56. The base section 55 extends from the cylindrical section 54 of the exposed tubular portion 50. The elastic section 56 extends from the base section 55. Referring to FIGS. 2 and 4, the inner tubular portion 51 passes through the first planar area 14 of the upper shell 10 and the plastic liner 2 and is in communication with the storage space 30.

Referring again to FIGS. 3 and 4, the first anti-leak assembly 6 provides leakproof connection between the first metallic joint 5 and the plastic liner 2, and includes a seal washer 60, a seal ring 61 and a fixing gasket 62. The seal washer 60 is placed around the inner tubular portion 51 of the first metallic joint 5 and placed in between the hollow cylinder 13 of the upper shell 10 and the plastic liner 2. The seal ring 61 is also placed around the inner tubular portion 51 of the first metallic joint 5 and is placed in between the plastic liner 2 and the fixing gasket 62. As best seen in FIG. 4, the fixing gasket 62 includes an annular disk 63, an inclined circumferential wall 64 and a flange 66. The annular disk 63 is placed around the inner tubular portion 51 of the first metallic joint 5. The inclined circumferential wall 64 extends outwardly from the periphery of the annular disk 63. The flange 66 extends from the periphery of the inclined circumferential wall 64 and abuts against an interior surface of the plastic liner 2. The annular disk 63 and the inclined circumferential wall 64 co-define an annular recession 65 for receiving the seal ring 61. It is noted that the elastic section 56 of the inner tubular portion 51 is thinner than the base section 55 of the same and is riveted to hold the first anti-leak assembly 6 and the plastic liner 2 against an interior surface of the first planar area 14 of the hollow cylinder 13 of the upper shell 10. Additionally, the seal ring 61 has a thickness slightly larger than a depth of the annular recession 65 of the fixing gasket 62 in such a way that the seal ring 61 can be tightly held against the plastic liner 2 and provides a better leakproof effect.

Figure 5:
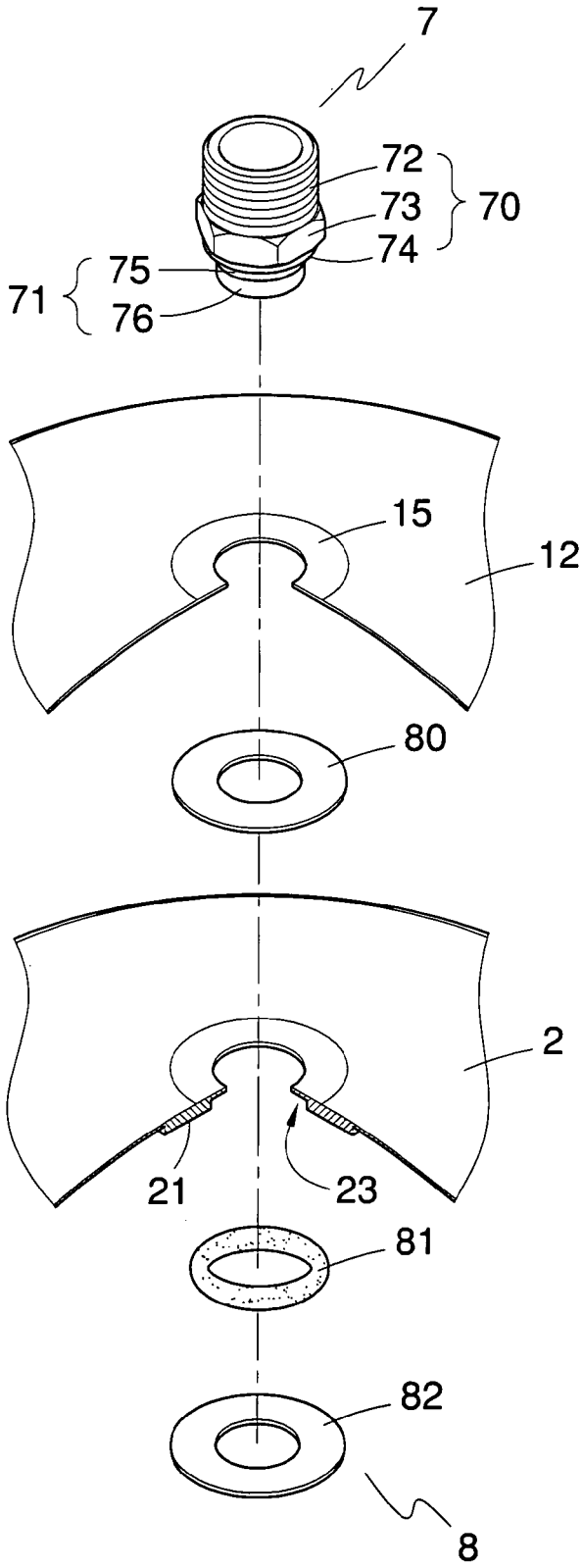
FIG. 5 is a fragmentary exploded view of the pressure tank, showing an arrangement among an upper shell, a second metallic joint and a second anti-leak assembly.

As shown in FIG. 5, the second metallic joint 7 is substantially identical to the first metallic joint 5 in construction and is mounted on the second planar area 15 of the circular plate 12. Specifically, the second metallic joint 7 includes an exposed tubular portion 70 and an inner tubular portion 71 joined together. The exposed tubular portion 70 is formed with a threaded section 72, a polygonal section 73 joined to the threaded section 72 and a cylindrical section 74 joined to the polygonal section 73. The threaded section 72 is provided for connection with another pipe (not shown). The cylindrical section 74 of the exposed tubular portion 70 is weld to an exterior surface of the second planar area 15 of the circular plate 12 of the upper shell 10. The inner tubular portion 71 is formed with a base section 75 and an elastic section 76 extending from the base section 75. Referring to FIG. 6, the inner tubular portion 71 passes through the second planar area 15 of the circular plate 12 and the inward protrusion 21 of the plastic liner 2 and is in communication with the storage space 30.

Referring back to FIG. 5, the second anti-leak assembly 8 is placed around the inner tubular portion 71 of the second metallic joint 7 in order to provide a leakproof connection between the second metallic joint 7 and the plastic liner 2. Specifically, the second anti-leak assembly 8 includes a seal washer 80, a seal ring 81 and a fixing gasket 82. The seal washer 80 is placed around the inner tubular portion 71 of the second metallic joint 7 and placed in between the circular plate 12 and the plastic liner 2. The seal ring 81 is also placed around the inner tubular portion 71, placed in between the inward protrusion 21 of the plastic liner 2 and the fixing gasket 82, and lodged in the annular recession 23 of the inward protrusion 21 of the plastic liner 2. Likewise, the seal ring 81 has a thickness slightly larger than a depth of the annular recession 23 of the inward protrusion 21 of the plastic liner 2. As shown in FIG. 6, the elastic section 76 of the inner tubular portion 71 is thinner than the base section 75 of the same and is riveted to hold the second anti-leak assembly 8 and the plastic liner 2 against an interior surface of the second planar area 15 of the circular plate 12 of the upper shell 10.

Referring to FIGS. 2 and 7, the nozzle 9 is mounted on the third planar area 16 of the lower shell 11 of the metallic vessel 1 and is in communication with the pneumatic room 31. Specifically, the nozzle 9 includes the third metallic joint 90, a third anti-leak assembly 96 and a one-way valve 99. The third metallic joint 90 has an exposed tubular portion 91 and an inner tubular portion 92. The inner tubular portion 92 has a protruding section 93, a cylindrical section 94 extending from the protruding section 93 and a threaded section 95 extending from the cylindrical section 94. The protruding section 93 of the inner tubular portion 92 is lodged in the annular recession 18 of the inward tubular protrusion 17 of the lower shell 11. The inner tubular portion 92 of the third metallic joint 90 passes through the third planar area 16 as well as the inward tubular protrusion 17 and is in communication with the pneumatic room 31.

Moreover, the third anti-leak assembly 96 of the nozzle 9 is placed around the inner tubular portion 92 of the third metallic joint 90 to provide leakproof connection between the third metallic joint 90 and the lower shell 11. The one-way valve 99 of the nozzle 9 is received in the third metallic joint 90, through which outside air or gas can be injected into the pneumatic room 31 to drive the flexible diaphragm 3. Specifically, the third anti-leak assembly 96 includes a seal ring 97 and a connecting member 98. The seal ring 97 of the third anti-leak assembly 96 is placed around the inner tubular portion 92 of the third metallic joint 90. And, the seal ring 97 is lodged in the annular recession 18 of the inward tubular protrusion 17 of the lower shell 11 and is sandwiched between the inward tubular protrusion 17 and the protruding section 93 of the inner tubular portion 92. The connecting member 98 of the third anti-leak assembly 96 defines a receptacle 19 for receiving the inward tubular protrusion 17 of the lower shell 11 and a screw hole 20 for receiving the threaded section 95 of the inner tubular portion 92 of the third metallic joint 90. In such a fashion, the nozzle 9 can be easily assembled and provides excellent leakproof function.

From the forgoing description, the present invention includes at least two metallic joints, namely the first and second metallic joints 5, 7 to provide plural access openings to connect with plural pipes. One of two metallic joints may serve as an inlet and the other as outlet for water or liquid so as to prevent the upper surface of the flexible diaphragm from accumulation of residue dust or dirt.

It will be appreciated that although a particular embodiment of the invention has been shown and described, modifications may be made. It is intended in the claims to cover such modifications which come within the spirit and scope of the invention.

The invention claimed is:

1. A pressure tank comprising:

a metallic vessel including upper and lower shells joined together; said upper shell having a circular plate and a hollow cylinder extending from the periphery of said circular plate; said metallic vessel defining a first planar area on said hollow cylinder, a second planar area on said circular plate and a third planar area on a bottom of said lower shell; said lower shell including an inward tubular protrusion extending inwardly from said third planar area of said lower shell; and said inward tubular protrusion defining an annular recession adjacent to said third planar area;

a plastic liner received in said upper shell of said metallic vessel and formed with an inward protrusion defining an annular recession therein;

a flexible diaphragm disposed in said plastic liner; said flexible diaphragm and said plastic liner co-defining a storage space therebetween; and said flexible diaphragm and said lower shell of said metallic vessel co-defining a pneumatic room therebetween;

a first metallic joint including an exposed tubular portion and an inner tubular portion joined together; said exposed tubular portion having a threaded section, a polygonal section joined to said threaded section and a cylindrical section joined to said polygonal section; said inner tubular portion being joined to said cylindrical section of said exposed tubular portion and passing through said first planar area of said hollow cylinder and said plastic liner to be in communication with said storage space; said cylindrical section of said exposed tubular portion being weld to an exterior surface of said first planar area of said hollow cylinder of said upper shell; said inner tubular portion including a base section and an elastic section extending from said base section; and said elastic section being riveted to press said plastic liner on an interior surface of said first planar area of said hollow cylinder of said upper shell;

a first anti-leak assembly including a seal washer, a seal ring and a fixing gasket; said seal washer being placed around said inner tubular portion of said first metallic joint and placed in between said hollow cylinder of said upper shell and said plastic liner; said seal ring being placed around said inner tubular portion of said first metallic joint and placed in between said plastic liner and said fixing gasket; said fixing gasket defining an annular recession therein for receiving said seal ring; and said seal ring having a thickness slightly larger than a depth of said annular recession of said fixing gasket;

a second metallic joint including an exposed tubular portion and an inner tubular portion joined together; said exposed tubular portion having a threaded section, a polygonal section joined to said threaded section and a cylindrical section joined to said polygonal section; said inner tubular portion passing through said second planar area of said circular plate and said inward protrusion of said plastic liner to be in communication with said storage space; said cylindrical section of said exposed tubular portion being weld to an exterior surface of said second planar area of said circular plate of said upper shell; said inner tubular portion having a base section and an elastic section extending from said base section; and said elastic section being riveted to press said plastic liner on an interior surface of said second planar area of said circular plate of said upper shell;

a second anti-leak assembly including a seal washer, a seal ring and a fixing gasket; said seal washer being placed around said inner tubular portion of said second metallic joint and placed in between said circular plate and said plastic liner; said seal ring being placed around said inner tubular portion of said second metallic joint and placed in between said inward protrusion of said plastic liner and said fixing gasket to be lodged in said annular recession of said inward protrusion; and said seal ring having a thickness slightly larger than a depth of said annular recession of said inward protrusion; and a nozzle mounted on said third planar area of said lower shell to be in communication with said pneumatic room and including a third metallic joint, a third anti-leak assembly and a one-way valve; said third metallic joint having an exposed tubular portion and an inner tubular portion; said inner tubular portion having a protruding section, a cylindrical section extending from said protruding section and a threaded section extending from said cylindrical section; said protruding section of said inner tubular portion being lodged in said annular recession of said inward tubular protrusion of said lower shell; said inner tubular portion of said third metallic joint passing through said third planar area and said inward tubular protrusion of said lower shell to be in communication with said pneumatic room; said third anti-leak assembly including a seal ring and a connecting member; said seal ring of said third anti-leak assembly being placed around said inner tubular portion of said third metallic joint, lodged in said annular recession of said inward tubular protrusion of said lower shell and placed in between said inward tubular protrusion of said lower shell and said protruding section of said inner tubular portion of said third metallic joint; said connecting member of said third anti-leak assembly defining a receptacle for receiving said inward tubular protrusion of said lower shell and a screw hole for receiving said threaded section of said inner tubular portion of said third metallic joint; and said one-way valve being received in said third metallic joint.

* * * * *